United States Patent [19]

Gariboldi et al.

[11] Patent Number: 4,724,687

[45] Date of Patent: Feb. 16, 1988

[54] THREAD FEEDING APPARATUS FOR A DOUBLE NEEDLE BED KNITTING MACHINE HAVING A PLURALITY OF FEED SYSTEMS

[75] Inventors: Franco Gariboldi, Turin; Paolo Conti, Via Neri di Bicci, 14, 50143 Firenze, both of Italy

[73] Assignees: Paolo Conti; Meritex s.r.L., both of Italy

[21] Appl. No.: 932,913

[22] Filed: Nov. 19, 1986

[30] Foreign Application Priority Data

Nov. 28, 1985 [IT] Italy ..... 9527 A/85

[51] Int. Cl.[4] ..... D04B 3/06

[52] U.S. Cl. ..... 66/125 R; 66/126 R; 66/132 R

[58] Field of Search ..... 66/126, 125, 132 R, 66/132 T, 127

[56] References Cited

U.S. PATENT DOCUMENTS

| | | | |
|---|---|---|---|
| 3,237,432 | 3/1966 | Jetté | 66/126 R |
| 3,861,176 | 1/1975 | McWhirter et al. | 60/126 R |
| 3,962,890 | 6/1976 | Krause | 66/123 |

*Primary Examiner*—Ronald Feldbaum

*Attorney, Agent, or Firm*—McGlew and Tuttle

[57] ABSTRACT

The thread feeding apparatus for double needle bed knitting machine to form tubular fabric comprises at least two thread-guides for the same number of thread feed systems for the same fabric, said thread-guides are displaced the one relative to the other upon the passage between one needle bed and the other and upon the reversal of the knitting direction, in order to maintain the same precedence order of the thread-guides in respect to the instantaneous direction of motion. In order to ensure the unwinding of the yarns with no crossing thereof, said yarns are unwound from bobbins of yarn which are co-axially disposed in a row, holes or other equivalent thread guiding means being provided, which guiding means rotate preferably with a continuous motion.

9 Claims, 18 Drawing Figures

Fig. 3
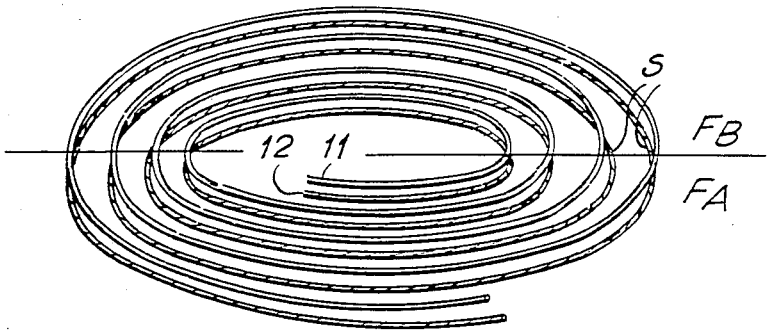
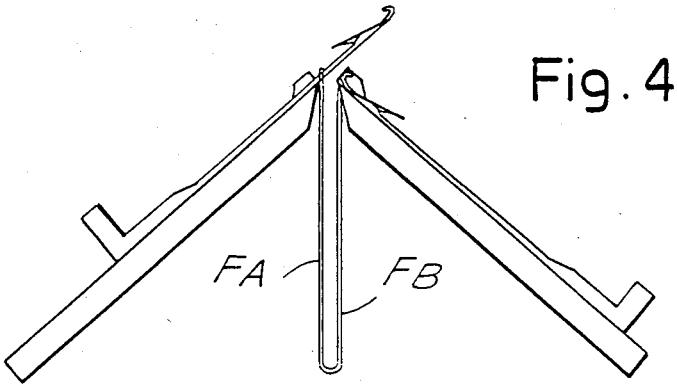
Fig. 4
Fig. 5
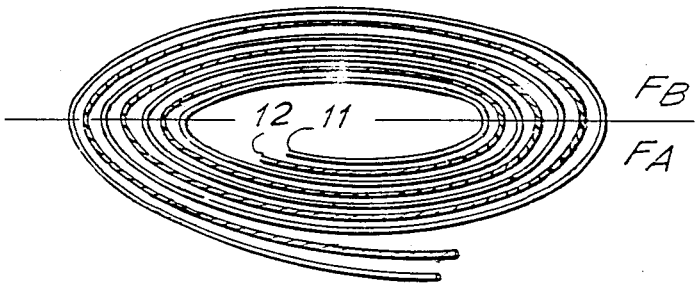

37
43
35
31B
41
39
31A
33B
33A
29B
29A
25
27B
27A
f6
21
23
TA
TB
TT

THREAD FEEDING APPARATUS FOR A DOUBLE NEEDLE BED KNITTING MACHINE HAVING A PLURALITY OF FEED SYSTEMS

The present apparatus is useful on a knitting machine—particularly of the straight or circular type—having a double needle bed, that is, having two sets of needles, when the work thereon is carried out in a reciprocating way in separate sectors of the needles front or of the needles periphery.

In particular, the present apparatus is to be used when, on the above mentioned types of machine, a knitted fabric has to be produced by a dual feed system, using two different types of yarn in each of said feed systems, and when, at the same time, tubular fabric has to be produced with spiral-shaped formation of the stitch rows, without any discontinuity.

A description of the working of the apparatus will be made with reference to a straight, double needle bed machine, but the same considerations apply to the double needle bed circular machines with a plurality of tubular fabrics each of which is knitted along opposite arcs of needles.

It is known to provide the arrangement (see FIGS. 1 to 4) of the feeding yarn carriers in a straight machine with double-feed carriage as schematically shown in FIG. 1. Numerals 1 and 3 indicate the two sets of cams carried by the carriage and intended for the lifting and the lowering of the needles; numerals 5 and 7 indicate the two thread-guides which run onto the bar 9 in synchronism with the carriage and in predetermined position with respect to the cams 1 and 3. Numerals 10 and 12 indicate the yarn bobbins for feeding the threads to the two thread-guides 5 and 7. By this traditional type of feed system, upon the phase of FIG. 1, with the left-to-right motion according to f1, the thread-guide 5 precedes the thread-guide 7. When the carriage and the thread-guides have arrived at the end of the run and reverse the motion, the thread-guide 7 is made to precede the thread-guide 5. If the machine is working on a single needle bed to form the fabric of FIG. 2, the thread F7 that has formed the row RB comes back, by this reversal, over itself and forms the row RC, while the thread F5 that had formed the row RA will have to pass over the two stitch rows RB and RC thus producing—upon the reversal—thread bridges P for the formation of the row RD. The same thing takes place if the machine works simultaneously on both the needle beds to produce a rib-stitch fabric.

Even if the machine works on both the needle beds using them one at a time subsequently to produce tubular fabric, a crossing over of the threads takes place, upon the reversal, as schematically shown at S in FIG. 3, where, for the sake of the drawing clarity, the stitch rows are represented by lines and the fabric is viewed from above, looking inside the tube; the points designated by 11 and 12 are the beginning of the rows of the first and second feed system. The lower part of the drawing indicated by FA (see also FIG. 4) is the one knitted on the fore needle beds and the upper part indicated by FB is the one knitted on the rear needle bed. In a fabric made in this way, the thread-crossings indicated by S make up two opposite longitudinal well-visible markings which are not aesthetically acceptable.

The apparatus of the present invention is intended to produce, on a double needle bed machine, a tubular fabric (like that of FIG. 3) without the crossings S and thus having a continuity in the spiral of the stitch rows produced by the two feed systems, as indicated in FIG. 5, which is similar-as far as the representation is concerned—to FIG. 3.

When two feed systems are provided to knit tubular fabrics through two circular needle beds, as for example in the Italian patent applications No. 9518 A/83, No. 9470 A/84, No. 9420 A/85 and No. 9419 A/85 (EP No. 84306248.0 and No. 85830201.1 and U.S. Ser. No. 651,605 and No. 758,540) thus forming the stitches in succession on the needles of one arc of a needle bed and on the needles of the corresponding arc of the other needle bed, the above mentioned problems arise upon the passage from one needle bed to the other, and in this case too, the problem can be solved by the present apparatus.

Substantially, the present thread feeding apparatus, for double needle bed knitting machines apt to form tubular fabric, provides that at least two thread-guides, for the same number of thread feed systems for the same fabric, be displaced—upon the passage between one needle bed to the other and upon the reversal of the knitting direction—one relative to the other in order to maintain the same order of priority of the thread-guides in respect to the instantaneous direction of the motion.

Correspondingly, the paths of the yarns that feed the thread-guides are cyclically modified to ensure the unwinding of the yarns with no crossing taking place. Advantageously, the yarn paths may be modified by a continuous motion of rotation so as to describe half a revolution between one knitting-direction reversal and the other.

The modification of the threads path can be attained by changing the position of the thread bobbins through a displaceable carrousel unit, but—according to an advantageous arrangement of the apparatus—at least two bobbins of yarn may be provided coaxially disposed in a row, and holes or other equivalent thread guiding means for the threads unwinding from said bobbins may be made to rotate with a continuous motion.

In a possible embodiment, an angularly movable core carries the thread-guides for the needles and is shifted through 180° on each reversal of the knitting direction.

In another possible embodiment, two thread-guides are mounted on two members sliding on common guides and capable of exchanging their position thanks to bevelled, cooperating profiles, the reverse slidings of the two members being operated upon each reversal of the knitting direction.

The invention will be better understood by following the description and the attached drawing, which shows a practical non limitative exemplification of the invention itself. In the drawing:

FIGS. 1 to 4 show—as already mentioned—a known disposition on straight needle beds, a portion of fabric formed on one needle bed, with two feed systems, a disposition of the rows during the knitting on two needle beds and with two feed systems, and a section of two straight needle beds inclined relative to each other;

FIG. 5 is similar to FIG. 3 and shows the rows disposition obtained by the present apparatus;

Figure 1:
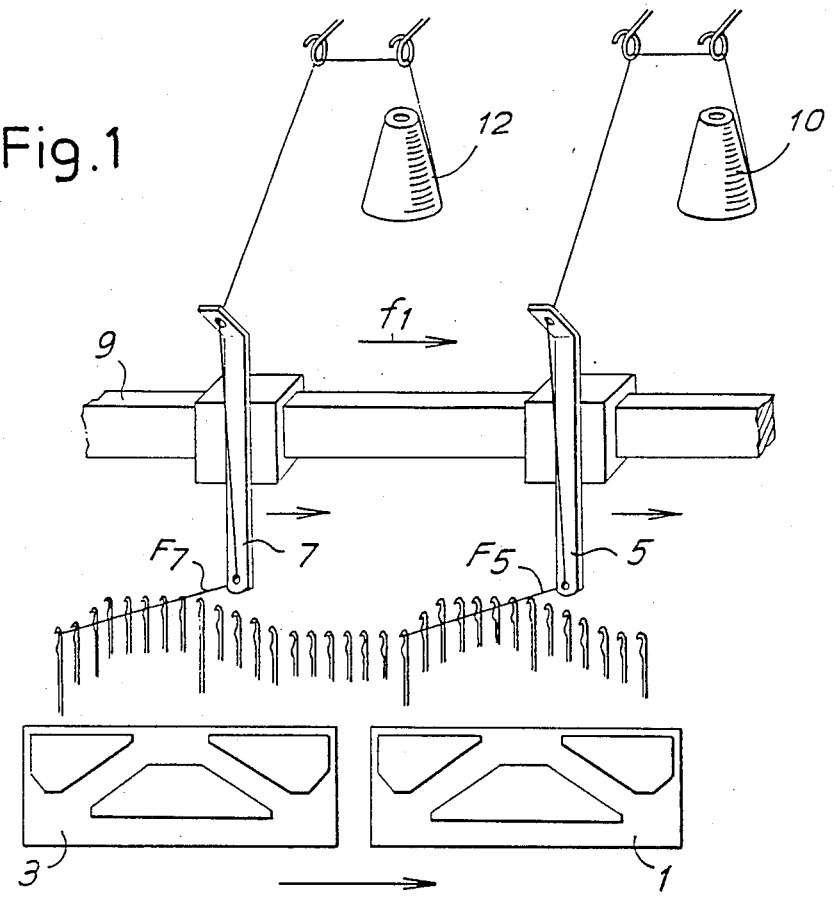
Figure 2:
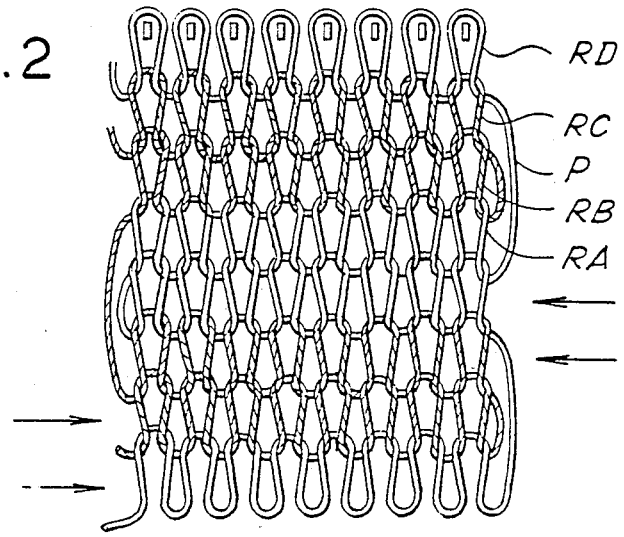

According to what is illustrated in FIGS. 6 to 12, on a slide guide 21—parallel to the fronts of the needles by which the portions TA and TB of the tubular fabric TT are formed—a slider or cursor 23 is slidingly mounted being moved in synchronism with the reciprocating carriage of the cams which drive the needles. The slider 23 receives a core 25 in an angularly movable fashion; this core 25 carries the two threading tubes or thread guides 27A and 27B. Means are provided able to operate the rotation of the core through half a revolution in the same direction, at the end of each run and thus upon any reversal of motion of the carriage 23.

The two thread-guides 27A and 27B carry the threads 29A and 29B coming from the bobbins 31A and 31B and sliding through two thread eyes or holes 33A, 33B.

The two bobbins 31A and 31B are preferably mounted with their axis in vertical arrangement and the side of the unwinding turns being downwardly directed. The bobbin 31B is mounted on a pin 35 fixed and integral with the structure 37 of the trestle. The bobbin 31A, instead, is mounted on a pin 39 secured on a frame 41 that can be rotated about an axis coincident with one of the pins 35 and 39; said frame 41 is rotated by a toothed pulley 43 rotating around the pin 35, integral to frame 41, and operated by a toothed belt 45.

The rotation of the frame 41 puts into rotation the bobbin 31A, which thus rotates on its own axis. The number of revolutions of the frame 41 is equal to and synchronized with the number of cycles (or periods) of the reciprocating motion of the cams-carrying carriage of the machine and thus of the cursor or slider 23, so that, for each run (or half cycle) of the slider 23, the frame 41 performs half a revolution. Substantially, the core 25 and the frame 41 perform equal angular movements at the same time, the first, in an intermittent way, and the other, in a continuous way.

Figure 6:
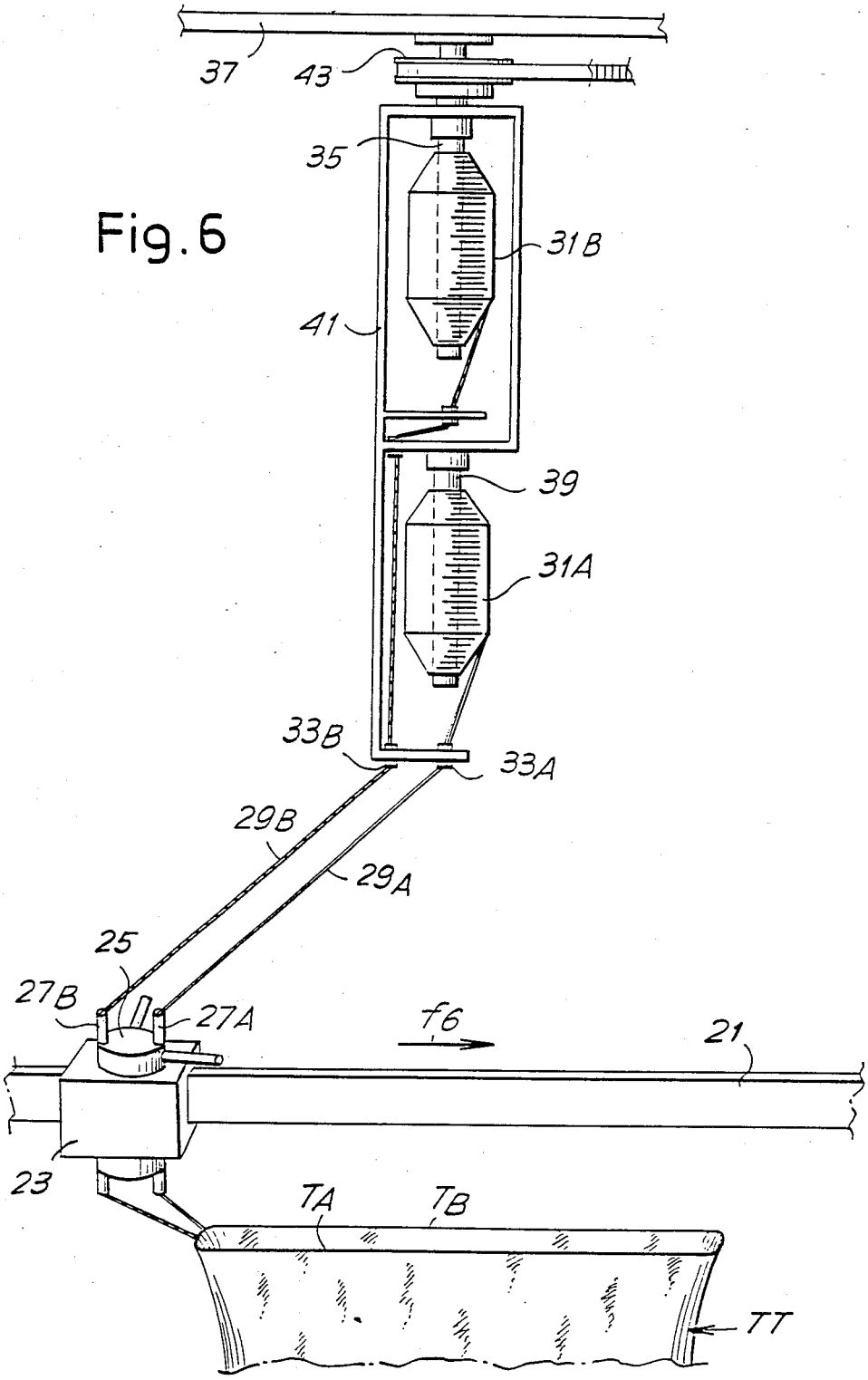
FIGS. 6 to 12 show, in geometrical and perspective views, different arrangements of an apparatus during a cycle, on a straight needle beds machine.

In the position represented in FIG. 6, the slider 23 is just starting the left-to-right run according to arrow f6, and the thread-guide 27A precedes the thread-guide 27B. The threads 29A, 29B which come from the bobbins 31A and 31B are in a position suitable for not getting entangled, since they also come respectively from the hole 33A which precedes the hole 33B upon the above mentioned direction of motion.

Figure 7:
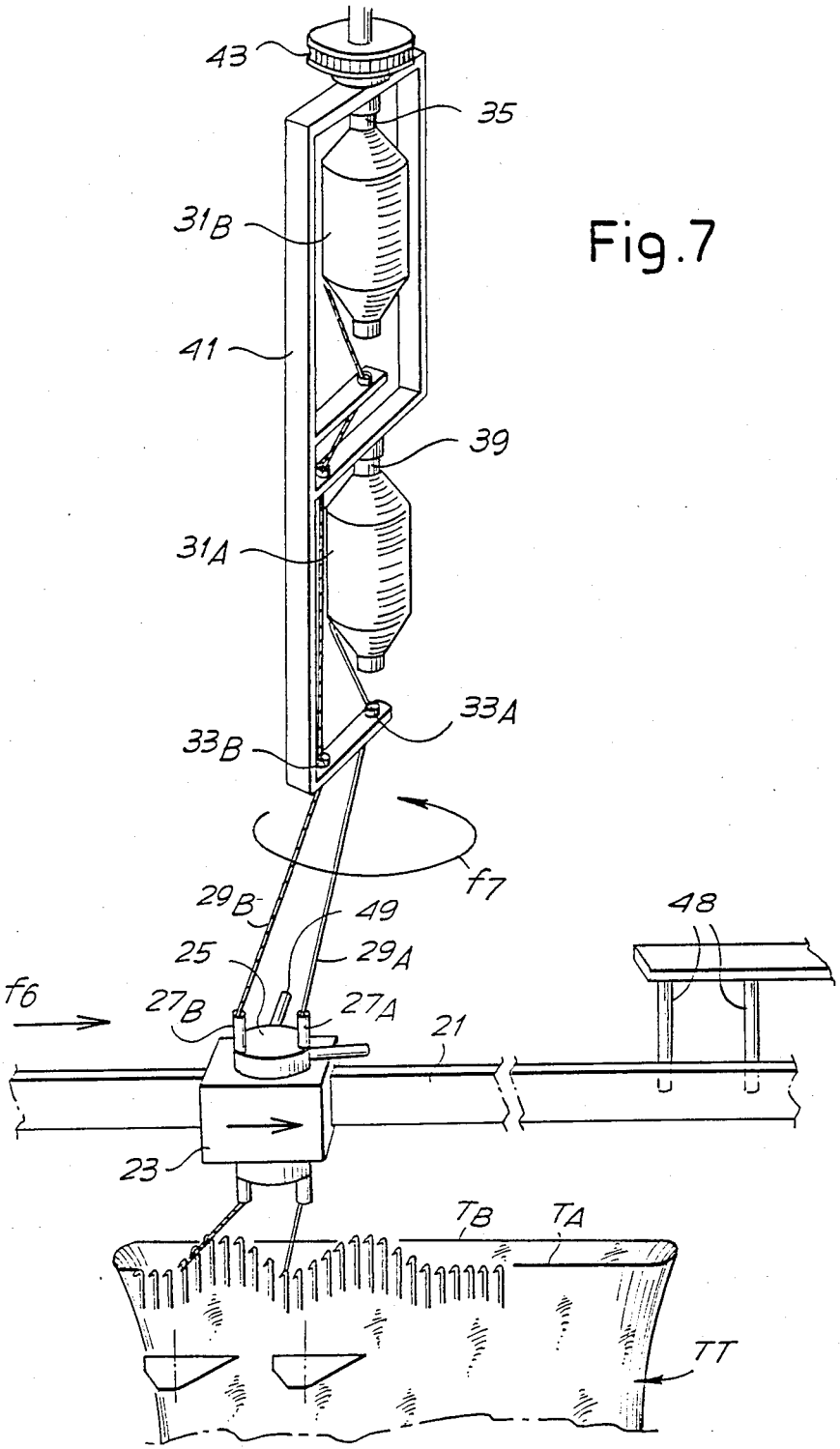
Figure 8:
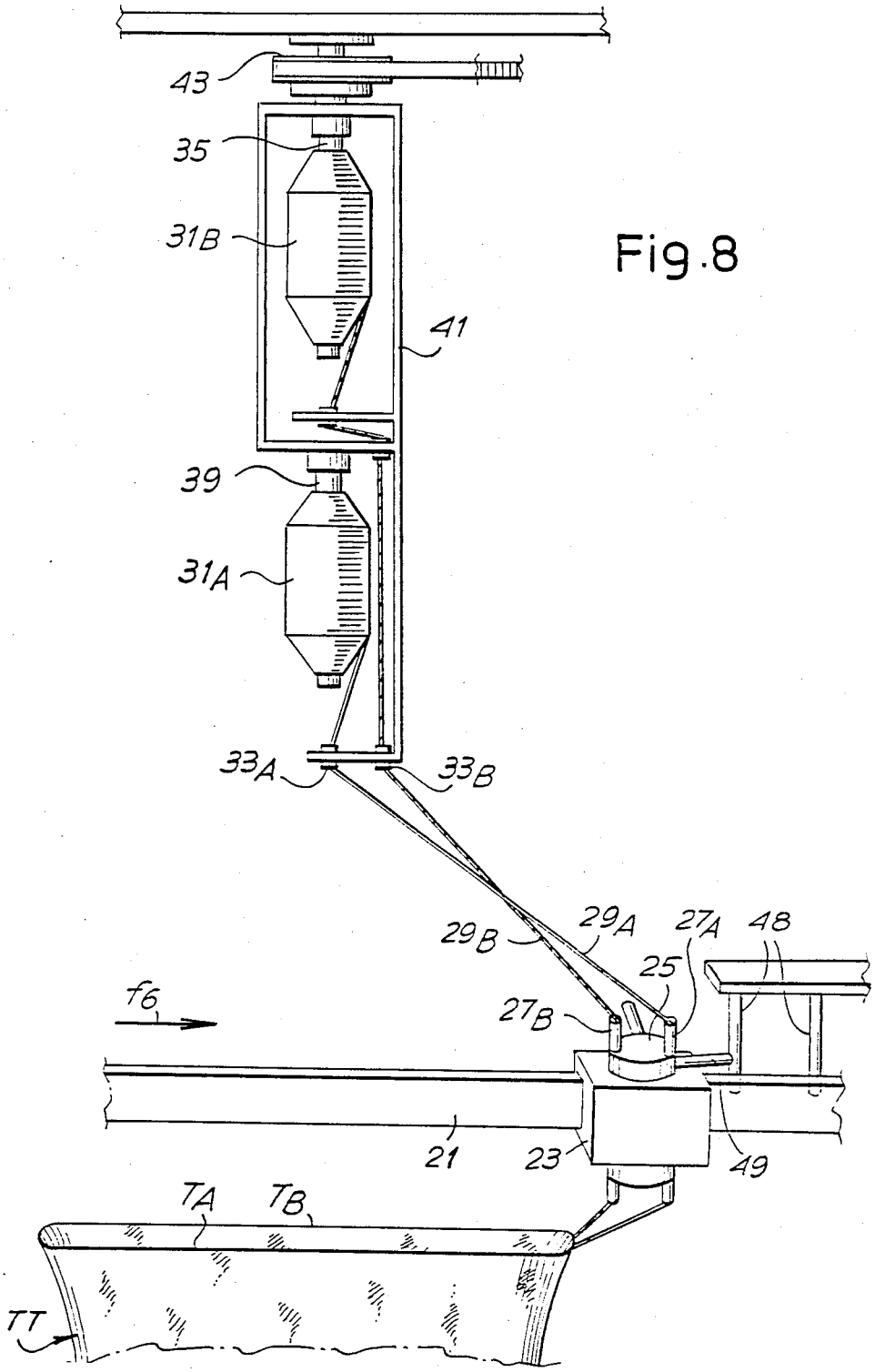

In FIG. 7 the slider of the thread-guides group is in its work phase nearly at half way of run, that is, nearly in the middle of the fabric front, and the feeding threads always follow a suitable path apt to not cross each other. The frame 41 will be partially rotated in the direction of arrow f7, since the rotating motion given by the pulley 43 is continuous. FIG. 8 shows the slider 23 which has already reached at the run-end according to arrow f6.

Figure 9:
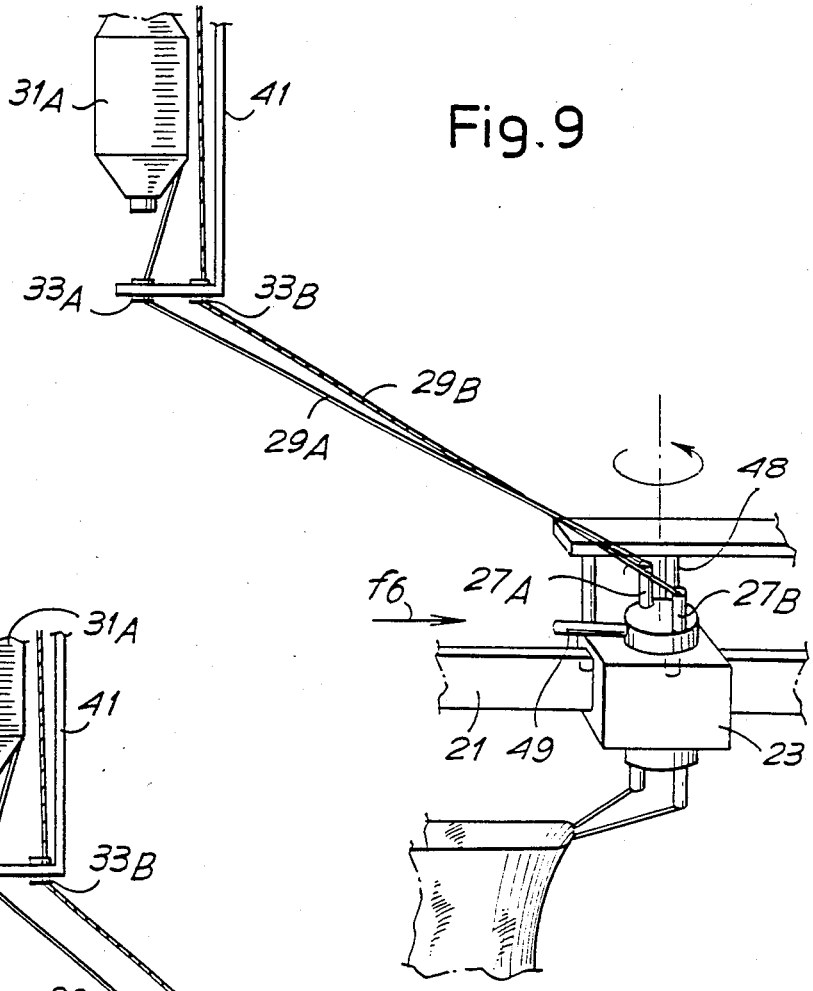

In the successive phase, a run is to be performed from right to left, in a direction opposite to f6, and it is necessary that the thread-guide 27A precedes again the thread-guide 27B in order to maintain the continuity of the spiral of the stitch rows. To this end, the core 25 of the slider 23 is rotated so as to bring the thread-guide 27A in front of the thread-guide 27B. FIG. 9 shows an intermediate position of said rotation phase. Since the frame 41 is rotating with a continuous motion, its rotation through half a revolution is almost completed as in the conditions shown by FIG. 9. The reason for which it is necessary to rotate also the frame 41 is that the hole 33A, through which the thread 29A comes out, must be brought again into an advanced position in respect to hole 33 B of the thread 27B.

Figure 10:
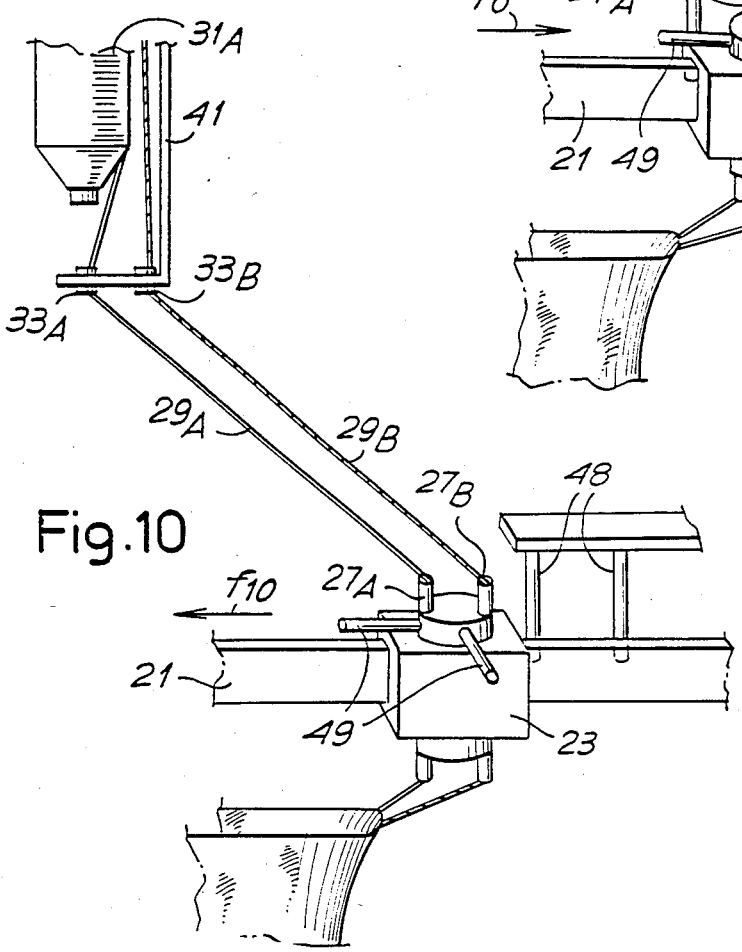

FIG. 10 shows the slider 23 being ready to perform the return run according to f10 and it may be seen that the thread-guide 27A precedes the thread-guide 27B; the frame 41 is completely rotated or about to be rotated, and the hole 33A precedes the hole 33B or very nearly so.

Figure 11:
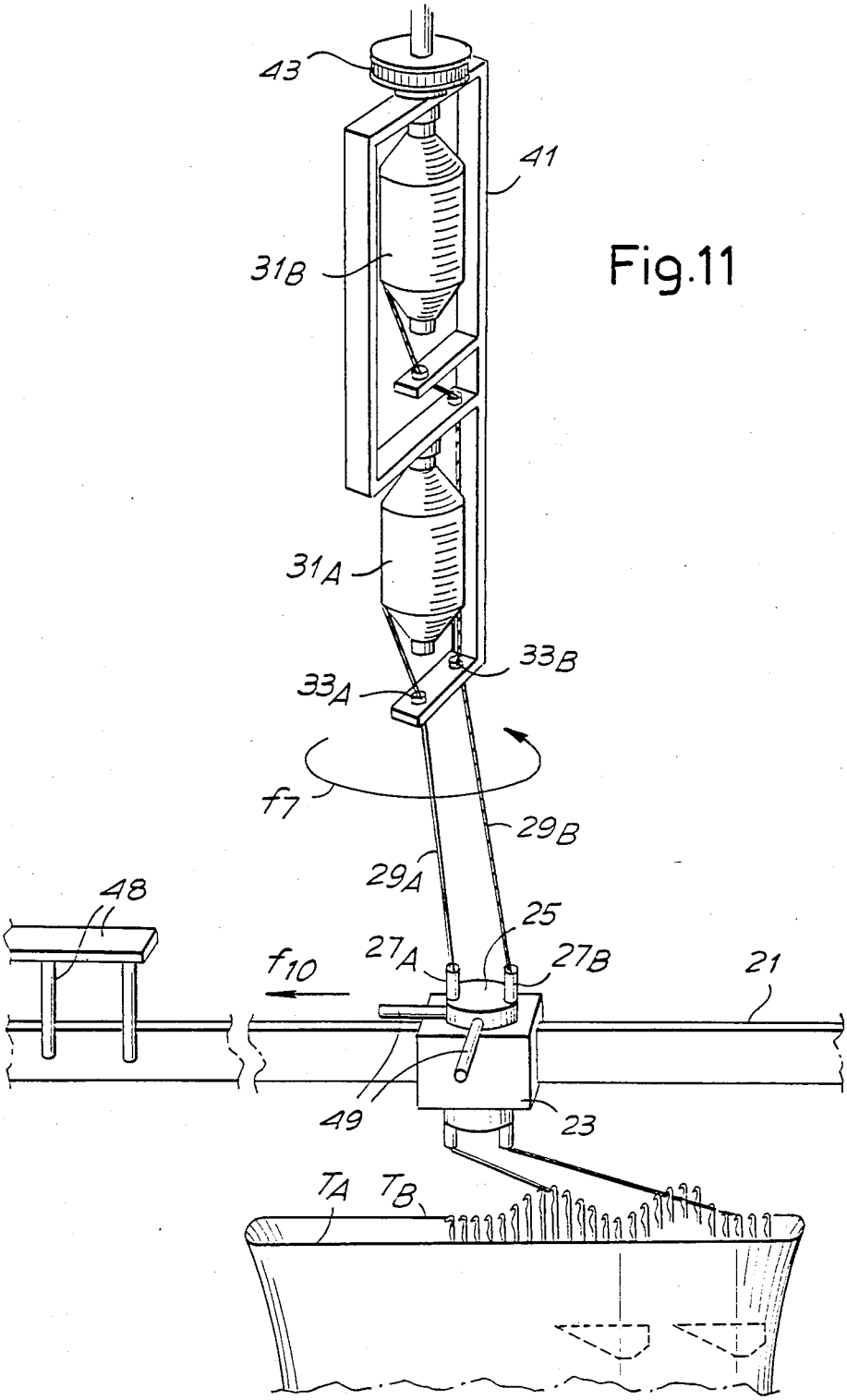

FIG. 11 shows the work phase in the return run.

Figure 12:
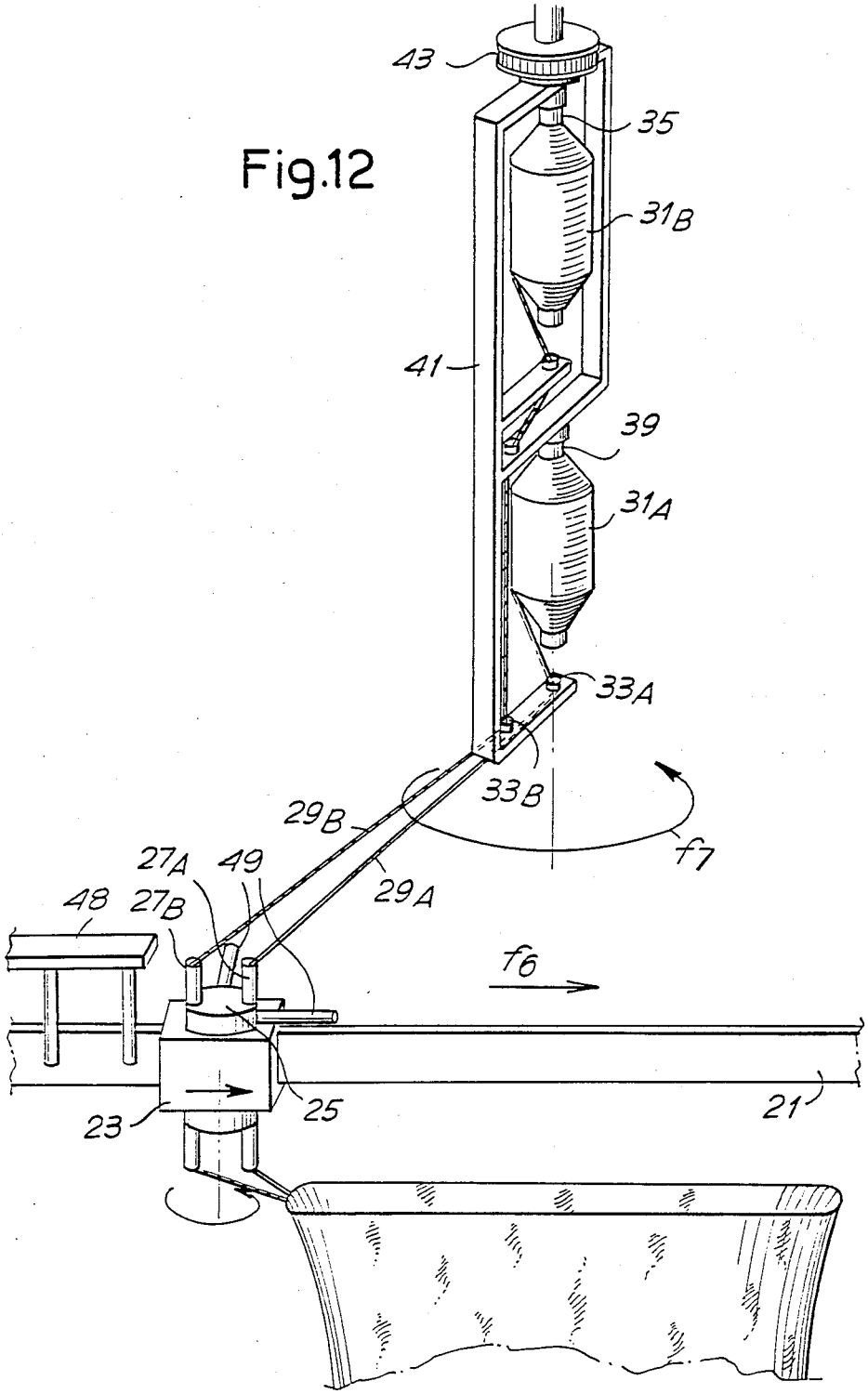

FIG. 12 shows the slider 23 at the end of its run and the core 25 which begins to rotate again—always in the same direction as before—to bring again the thread-guide 27A before the one indicated by 27B. Also the frame 41 keeps on rotating.

The control for the angular displacement of the core 25 at the end of each run may be achieved through suitable fixed pawls like those indicated by 48, which act, one after the other, on two radial pins 49 provided—in the form of a Maltese cross—on the core 25. In this way, there is obtained a total angular displacement of 180° over two time periods. This operation is performed at each run-end by means of pawls 48 on opposite sides of the guide 21.

Figure 13:
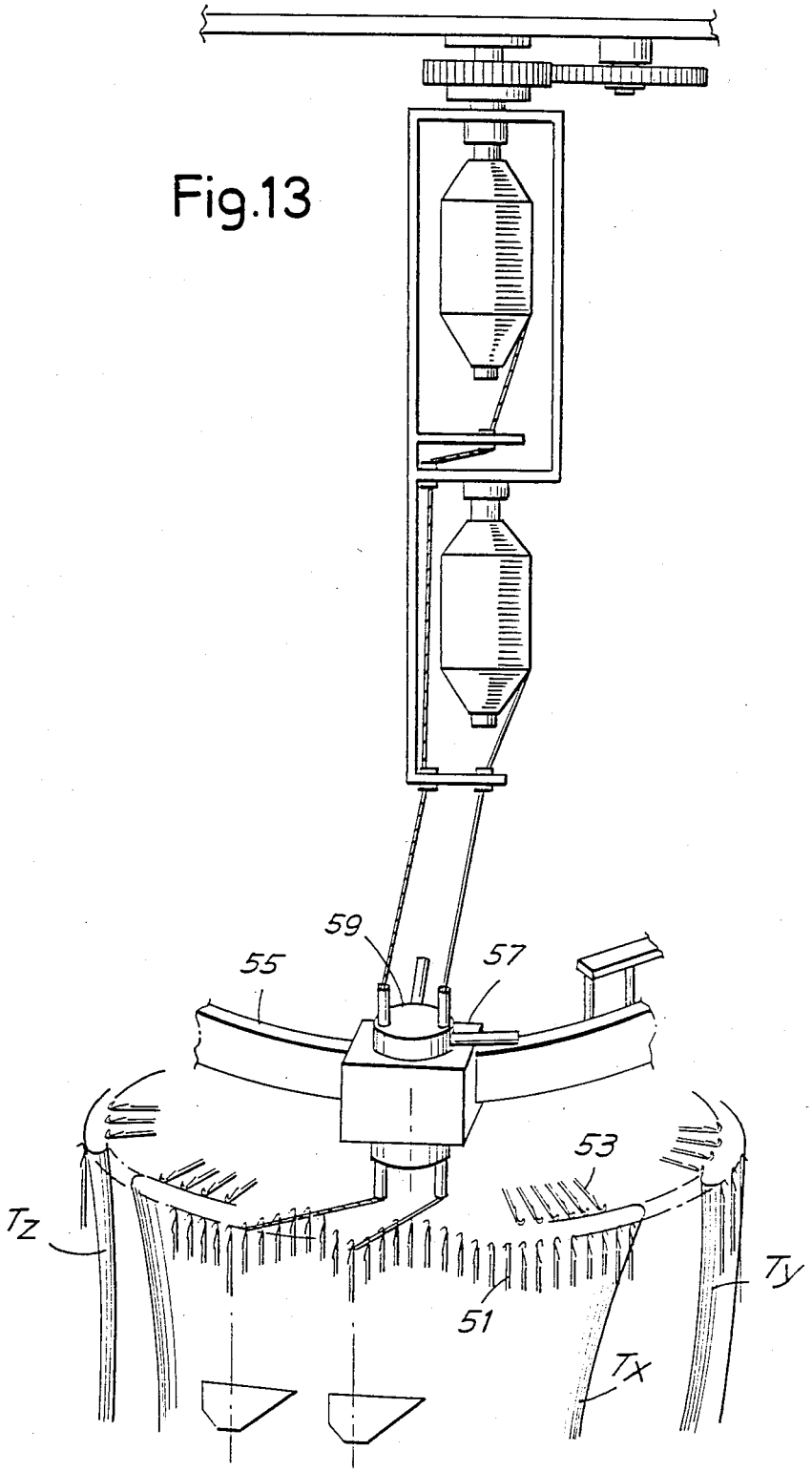
FIG. 13 shows a schematic representation of an apparatus applied to a circular machine.

FIG. 13 shows a feasible application of the apparatus to a circular machine, on which some tubular fabrics TX, TY, TZ are produced by separated sectors of the circumference of the cylinder of the needles 51 and of the plate of the radial needles 53. Numeral 55 indicates an arcuate guide for the sliding of sliders 57, one for each of the tubular fabrics TX, TY, TZ, and each being provided with a core 59 exhibiting two thread-guides for two threads coming from respective bobbins associated with a corresponding frame like the one indicated by 41. The operation for each fabric is fully equivalent to tht described above for a straight machine, except for the curvature of the working fronts and of the guide 55.

Figure 14:
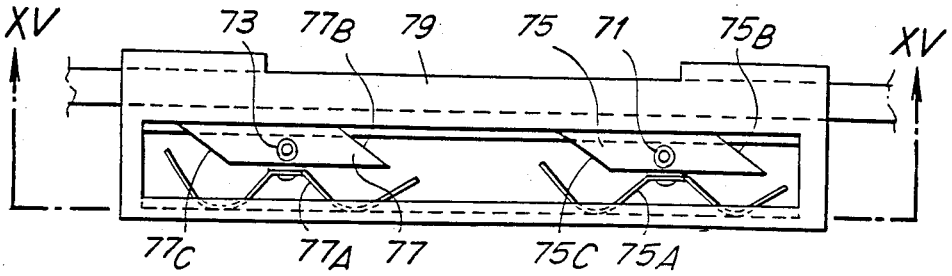
FIGS. 14 to 17 show an embodiment other than that of FIGS. 6 to 12, in plan view and in sections according to XV—XV of FIG. 14 and XVI—XVI and XVII—XVII of FIG. 15.
Figure 15:
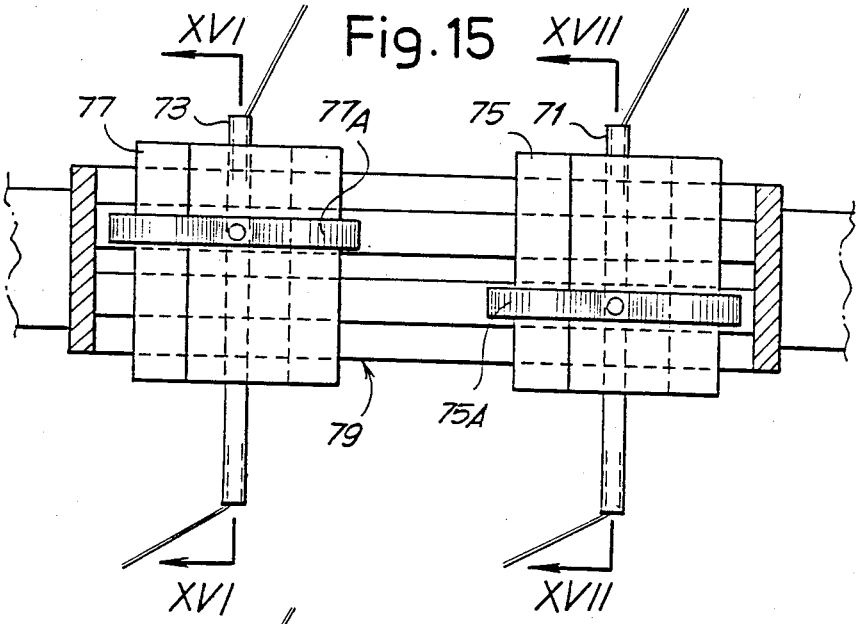
Figure 16:
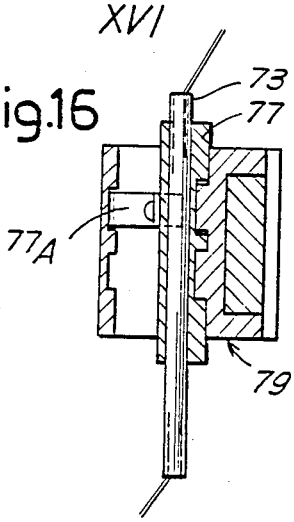
Figure 17:
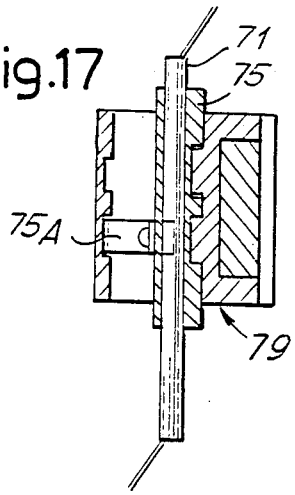

FIGS. 14 and 15 show a feasible embodiment of the apparatus, in which the overall dimensions are smaller, thus giving rise to a more elongated and flattened apparatus. The two threading tubes or thread guides 71 and 73 are not mounted on a rotating core, but they are mounted on flat, independent and independently sliding units 75 and 77 which, by means of particular end bevels, may exchange their position within a block 79 which forms slide guides. The units 75, 77 are guided inside the block 79 and urged by springs 75A and 77A. The units 75 and 77 reproduce, as far as the threads are concerned, an exchange effect identical to that of the above mentioned apparatus having the core angularly displaced. Also this type of thread-guides group must operate in connection with a rotating bobbins-holder frame, like the one above described.

The sliding units 75 and 77 exchange their position each time by superimposing onto one another because of the bevels 75B, 75C and 77B, 77C, and, during the changing over, one of the sliding units remains in contact with the guides on the block 79 and the other remains guided by the springs 75A and 77A.

Figure 18:
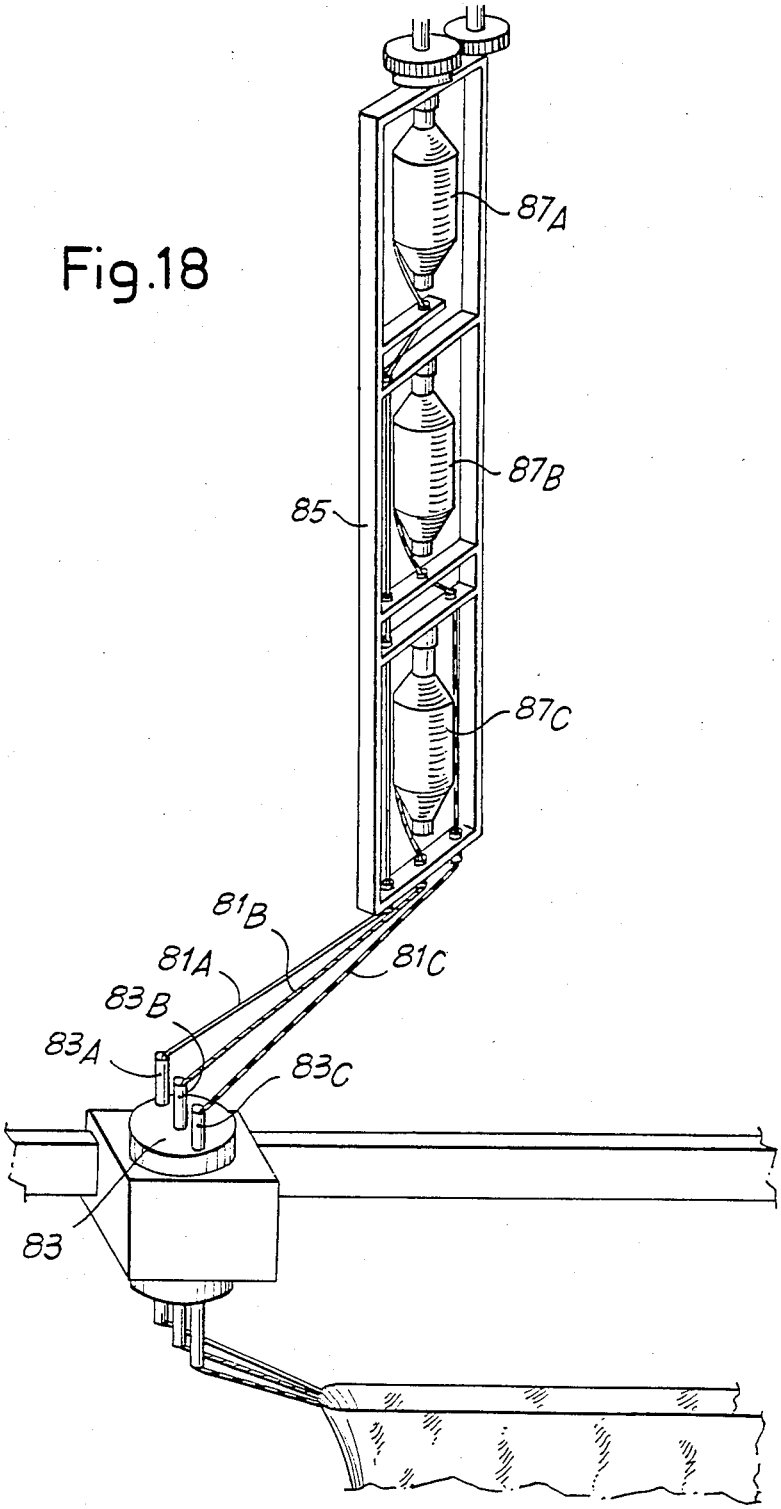
FIG. 18 shows a modified embodiment.

FIG. 18 shows an embodiment in which three yarn feed systems 81A, 81B and 81C are provided for three thread-guides 83A, 83B and 83C, carried by the core 83 which is similar to that indicated by 25; the thread-guide 83B is coaxial to the core, and the other two thread-guides are symmetrically located facing each other; a frame 85, similar to the one indicated by 41, is combined with three feeding bobbins 87A, 87B, 87C. The thread-guide 83B is always in an intermediate position, and those indicated by 83A and 83C exchange their position as in the preceding case.

In order to reduce at most the path length changes of the threads 29A, 29B or 81A, 81C (or equivalent), the bobbins may be disposed as far away as possible from the position-commutable thread-guides; and suitable yarn recuperators will be provided in any case.

It is understood that the drawing shows an exemplification given only as a pratical demonstration of the invention, as this may vary in the forms and dispositions without nevertheless departing from the idea on which the invention itself is based. For example, the bobbins can be disposed in a carrousel unit having perimetral seats, rather than providing a frame with coaxial lined-up seats. The feed systems may also be more than three, for example four.

We claim:

1. In a thread feeding apparatus, for a double needle bed knitting machine having a forward needle bed and a return needle bed to form tubular fabric, a plurality of at least two thread guides arranged for cyclical travel in a selective precedence order in succession operatively one after the other along the forward needle bed in a forward knitting direction in a forward run, and upon reversal in the same said order in succession operatively one after the other along the return needle bed in a return knitting direction in a return run, for reversal to repeat the cyclical travel.

a corresponding plurality of at least two thread feed systems, each system being arranged for feeding thread to a corresponding thread guide, for feeding the threads in said same order in succession operatively one after the other to needles of the respective bed for knitting corresponding courses in succession in the same fabric, and thread guide displacement means arranged for operatively displacing the guides reversibly relative to one another upon reversal of the cyclical travel from one knitting direction to the other, so as to maintain said same order of the guides and in turn of the corresponding threads being fed thereto by the systems in each particular knitting direction of the cyclical travel.

2. Apparatus of claim 1 wherein thread feed system displacement means are provided for cyclically displacing the systems in operative conjunction with the thread guide displacement, so as to insure the unwinding of the threads with no crossing of one thread relative to any other, consequent reversal of the knitting direction during cyclical travel of the guides.

3. Apparatus of claim 2 wherein cyclical displacement members are provided for defining the paths of the threads being fed by the systems to the guides, and the feed system displacement means are arranged for cyclically displacing the members, so as to insure such thread unwinding with no said crossing thereof.

4. Apparatus of claim 2 wherein the members are rotating members, and the feed system displacement means are operatively arranged for rotating the members with a continuous motion, so as to describe half a revolution between one reversal of the knitting direction and another.

5. Apparatus of claim 1 wherein the guides are carried by an angularly movable core which is arranged for said cyclical travel and for angular movement through a displacement angle of substantially 180 degrees upon each reversal of the knitting direction.

6. Apparatus of claim 1 wherein two thread guides are mounted respectively on two travel units correspondingly having forward direction and return direction cooperating bevelled end profiles, the units being arranged for sliding in said order in succession one after the other along the needle beds on common slide elements for said cyclical travel, and being further arranged for relative displacement to each other in a crosswise direction relative to the elements at the end of a particular run, so as to permit the succeeding unit to slide past the preceding unit via coaction of the adjacent cooperating bevelled end profiles and thereby exchange their positions at the end of such run, for reversal for the next run in said same order.

7. In a thread feeding apparatus, for a double needle bed knitting machine to form tubular fabric, at least two thread guides for the same number of thread feed systems for the same fabric, thread guide displacement means for displacement of said thread guides, one relative to one the other, upon passage between one needle bed and the other, and upon reversal of the knitting direction, in order to maintain the same precedence order of the thread guides in respect to the particular direction of motion, members for defining the paths of the threads for feeding the thread guides, and member displacement means for cyclically displacing the members in order to insure the unwinding of the threads with no crossing thereof.

8. In a thread feeding apparatus, for a double needle bed knitting machine to form tubular fabric, at least two thread guides for the same number of thread feed systems for the same fabric, thread guide displacement means for displacement of said thread guides, one relative to one the other, upon passage between one needle bed and the other, and upon reversal of the knitting direction, in order to maintain the same precedence order of the thread guides in respect to the particular direction of motion, at least two thread bobbins coaxially disposed in a row, thread guide members for defining the paths of the threads from the bobbins for feeding the thread guides, and rotating member displacement means for cyclically displacing the members in order to insure the unwinding of the threads with no crossing thereof.

9. Apparatus of claim 8 wherein the member displacement means are arranged to rotate with a continuous motion.

* * * * *